US010625327B2

(12) United States Patent
López Lage

(10) Patent No.: US 10,625,327 B2
(45) Date of Patent: Apr. 21, 2020

(54) TOOL FOR HOT FORMING STRUCTURAL COMPONENTS

(71) Applicant: AUTOTECH ENGINEERING, S.L., Amorebieta-etxano (ES)

(72) Inventor: Manuel López Lage, Abrera (ES)

(73) Assignee: Autotech Engineering A.I.E., Amorebieta-Etxano (ES)

( * ) Notice: Subject to any disclaimer, the term of this patent is extended or adjusted under 35 U.S.C. 154(b) by 138 days.

(21) Appl. No.: 15/536,225

(22) PCT Filed: Dec. 17, 2015

(86) PCT No.: PCT/EP2015/080368
§ 371 (c)(1),
(2) Date: Jun. 15, 2017

(87) PCT Pub. No.: WO2016/097224
PCT Pub. Date: Jun. 23, 2016

(65) Prior Publication Data

US 2017/0348753 A1 Dec. 7, 2017

(30) Foreign Application Priority Data

Dec. 18, 2014 (EP) ..... 14382534

(51) Int. Cl.
*B21D 37/16* (2006.01)
*C21D 1/673* (2006.01)
(Continued)

(52) U.S. Cl.
CPC ..... *B21D 37/16* (2013.01); *B21D 22/022* (2013.01); *B21D 47/00* (2013.01); *C21D 1/673* (2013.01); *C21D 1/34* (2013.01); *C21D 9/48* (2013.01)

(58) Field of Classification Search
CPC .... B21D 37/16; B21D 22/208; B21D 22/022; B21D 35/006; B21D 24/16; B21D 47/00; C21D 1/34; C21D 9/48
(Continued)

(56) References Cited

U.S. PATENT DOCUMENTS 3,584,487 A * 6/1971 Carlson ..... B21D 37/16 219/650
3,703,093 A * 11/1972 Komatsu ..... B21D 24/16 148/647
(Continued)

FOREIGN PATENT DOCUMENTS

DE 890 035 C 9/1953
DE 10 2004 026 762 A1 2/2006
(Continued)

OTHER PUBLICATIONS

International Search Report and Written Opinion of the International Searching Authority for corresponding International Patent No. PCT/EP2015/080368 dated Mar. 15, 2016, 11 pages.
(Continued)

*Primary Examiner* — David B Jones
(74) *Attorney, Agent, or Firm* — Finnegan, Henderson, Farabow, Garrett & Dunner, LLP

(57) ABSTRACT

A tool for manufacturing hot formed structural components having locally different microstructures and mechanical properties, the tool comprising upper and lower mating dies, each die being formed by two or more die blocks (10) comprising one or more working surfaces (34) that in use face the structural component to be formed and one or more supporting blocks, the upper and lower dies comprising die blocks are adapted to operate at different temperatures corresponding to zones of the structural component to be formed having locally different microstructures and mechanical properties, the die blocks including one or more
(Continued)

warm die blocks adapted to operate at a higher temperature, and one or more cold die blocks adapted to operate at a lower temperature, and wherein at least one of the warm die blocks is an electrically conductive die block which is electrically connected to a current source configured to provide a DC current through the die block to control the temperature of the die block. Furthermore, a method for manufacturing hot formed structural components is also provided.

13 Claims, 2 Drawing Sheets

(51) Int. Cl.

| | |
|---|---|
| ***B21D 22/02*** | (2006.01) |
| ***B21D 47/00*** | (2006.01) |
| *C21D 9/48* | (2006.01) |
| *C21D 1/34* | (2006.01) |

(58) Field of Classification Search
USPC ..... 72/342.92
See application file for complete search history.

(56) References Cited

U.S. PATENT DOCUMENTS

| | | | | |
|---|---|---|---|---|
| 7,302,821 | B1 | 12/2007 | Dariavach et al. | |
| 9,061,340 | B2 * | 6/2015 | Lee | B21D 35/006 |
| 10,022,767 | B2 * | 7/2018 | Kang | B21D 22/022 |
| 10,086,421 | B2 * | 10/2018 | Graff | B21D 22/022 |
| 10,245,632 | B2 * | 4/2019 | Luetkemeyer | B21D 22/208 |
| 2011/0031442 | A1 | 2/2011 | Suh et al. | |
| 2013/0205863 | A1 | 8/2013 | Loesch | |
| 2014/0260493 | A1 | 9/2014 | Yoon | |
| 2017/0348753 | A1 * | 12/2017 | Lopez Lage | B21D 37/16 |

FOREIGN PATENT DOCUMENTS

| | | | |
|---|---|---|---|
| DE | 10 2005 032 113 | B3 | 2/2007 |
| DE | 102005032113 | | 2/2007 |
| FR | 2 927 828 | A | 8/2009 |
| JP | 2006-116605 | A | 5/2006 |
| JP | 2007-075835 | A | 3/2007 |
| JP | 2007-190563 | A | 8/2007 |
| JP | 2013-013907 | A | 1/2013 |
| JP | 2014-503360 | | 2/2014 |
| RU | 2089316 | C1 | 9/1997 |
| SU | 1323167 | A1 | 7/1987 |
| SU | 1328032 | A1 | 8/1987 |
| SU | 1333446 | A1 | 8/1987 |
| SU | 1447481 | A1 | 12/1988 |
| WO | WO 2014/123855 | A1 | 8/2014 |

OTHER PUBLICATIONS

Extended European Search Report for corresponding European Patent Application No. 14382534.7 dated Jun. 9, 2015, 6 pages.

* cited by examiner

TOOL FOR HOT FORMING STRUCTURAL COMPONENTS

This application is a National Stage of PCT/EP2015/080368, filed on Dec. 17, 2015, which claims the benefit of European Patent Application EP14382534.7 filed on Dec. 18, 2014, and which applications are incorporated herein by reference. To the extent appropriate, a claim of priority is made to each of the above disclosed applications.

The present disclosure relates to tools for manufacturing hot formed structural components having locally different microstructures and mechanical properties and methods therefor.

BACKGROUND

The demand for weight reduction in the automotive industry has led to the development and implementation of lightweight materials, and related manufacturing processes and tools. The growing concern for occupant safety also leads to the adoption of materials which improve the integrity of the vehicle during a crash while also improving the energy absorption.

A process known as Hot Forming Die Quenching (HFDQ) uses boron steel sheets to create stamped components with Ultra High Strength Steel (UHSS) properties, with tensile strengths up to 1,500 MPa or even more. The increase in strength allows for a thinner gauge material to be used, which results in weight savings over conventionally cold stamped mild steel components.

Typical vehicle components that may be manufactured using the HFDQ process include: door beams, bumper beams, cross/side members, A/B pillar reinforcements, and waist rail reinforcements.

Hot forming of boron steels is becoming increasingly popular in the automotive industry due to their excellent strength and formability. Many structural components that were traditionally cold formed from mild steel are thus being replaced with hot formed equivalents that offer a significant increase in strength. This allows for reductions in material thickness (and thus weight) while maintaining the same strength. However, hot formed components offer very low levels of ductility and energy absorption in the as-formed condition.

In order to improve the ductility and energy absorption in specific areas of a component such as a beam, it is known to introduce softer regions within the same component. This improves ductility locally while maintaining the required high strength overall. By locally tailoring the microstructure and mechanical properties of certain structural components such that they comprise regions with very high strength (very hard) and regions with increased ductility (softer), it may be possible to improve their overall energy absorption and maintain their structural integrity during a crash situation and also reduce their overall weight. Such soft zones may also advantageously change the kinematic behaviour in case of a collapse of a component under an impact.

Known methods of creating regions with increased ductility ("softzones" or "soft zones") in vehicle structural components involve the provision of tools comprising a pair of complementary upper and lower die units, each of the units having separate die elements (steel blocks). The die elements may be designed to work at different temperatures, in order to have different cooling rates in different zones of the part being formed during the quenching process, and thereby resulting in different material properties in the final product e.g. soft areas. E.g. one die element may be cooled in order to quench the corresponding area of the component being manufactured at high cooling rates and by reducing the temperature of the component rapidly. Another neighbouring die element may be heated in order to ensure that the corresponding portion of the component being manufactured cools down at a lower cooling rate, and thus remaining at higher temperatures than the rest of the component when it leaves the die.

In order to heat the die elements, electrical heaters located inside the die elements and/or channels with hot liquids e.g. oils may be used.

One problem related with this sort of heating may be that it is necessary to machine the die elements in order to allocate the electrical heaters and/or the channels with hot liquids. Machining the die elements may be costly and sometimes difficult to perform, especially if the geometrical shape of the die elements is complex. Reliability is also an important factor. In the channels with hot liquid, hot liquid leakages might occur and repair can take time. In the electrical heaters, malfunctioning heaters might be difficult to detect and repair.

Moreover, the temperature of the die should preferably be as homogenous as possible in order to create an accurate soft zone. In the above commented solutions, the heat focus may be at a point or along a line, and thus the die elements surface are not heated uniformly. This could lead to different material properties in the same portion of the structural component.

Additionally, in the channels with the hot liquid solution, hot liquid leakages may occur. This can lead to an increase of the risk for the operator especially if the operator may be standing near the leakage. Furthermore, the repair can take time and, in some cases, a new die element with the machined channels may be required.

DE102005032113 discloses an apparatus for thermally deforming and partially hardening a component in a mold of at least two parts, between which the component, at its hardening temperature or above, is compressed to the mold contour by a press, each mold part is subdivided into segments separated by thermal insulation. The segments are adjustable to different, controlled temperatures for adjusting the component to different temperatures during pressing.

US2014260493 is related to a hot stamping mold apparatus. This apparatus may include a bottom part equipped on a bolster and a top part equipped on a slider, wherein the bottom part and the top part each include a cooling mold including a plurality of coolant chambers formed therein, a heating mold installed at a side of the cooling mold to form a formed surface together with the cooling mold and provided with a heating cartridge installed at a side of the heating mold.

DE102004026762 discloses a press tool for metal sheets includes a heated section with integral electric heating elements for areas of large press changes. The heated section is thermally insulated from the rest of the tool system by a ceramic layer integrated into the tool. The heated tool section can be made of thermally conducting ceramic.

FR2927828 discloses a thermoforming mold for forming and cooling a steel part from a blank, the tool comprising: at least one punch and at least one die the punch and the die each comprising: at least a first portion (21, 31) corresponding to a hot zone (11) of the stamping tool and at least one second portion (22, 32) corresponding to a cold zone (12) of the stamping tool in the cold zone, the second portion of the punch and the second part of the die coming into contact with the blank when the tool is closed It is an object of the present disclosure to provide improved tools for manufacturing hot-formed vehicle structural components with regions of high strength and other regions of increased ductility (soft zones).

SUMMARY

In a first aspect, a tool for manufacturing hot formed structural components having locally different microstructures and mechanical properties is provided. The tool comprising upper and lower mating dies and each die is formed by two or more die blocks comprising one or more working surfaces that in use faces the structural component to be formed. The upper and lower dies comprise at least two die blocks adapted to operate at different temperatures corresponding to zones of the structural component to be formed having locally different microstructures and mechanical properties. The die blocks include one or more warm die blocks adapted to operate at a higher temperature, and one or more cold die blocks adapted to operate at a lower temperature. At least one of the warm die blocks is an electrically conductive die block which is electrically connected to a current source configured to provide a DC current through the die block to control the temperature of the die block.

According to this aspect, an electrically conductive die block is electrically connected to a current source, thus a current flow may be created through the die block. With this arrangement, the electrically conductive die block may be heated up due to its internal resistance against the current flow. Furthermore, the temperature may be homogenous in the working surfaces, which in use, face the structural component, thus the temperature distribution may be improved.

In a second aspect, a method for manufacturing hot formed structural components may be provided. The method comprises: providing a tool according to the first aspect. The method further includes providing a blank. The blank may be compressed between the upper and lower mating dies. The connectors of one die block may be connected to a current source configured to provide a DC current. Then, the least two die blocks may be operated at different temperatures corresponding to zones of the blank to be formed having locally different microstructures and mechanical properties by applying DC current.

BRIEF DESCRIPTION OF THE DRAWINGS

Non-limiting examples of the present disclosure will be described in the following with reference to the appended drawings, in which.

DETAILED DESCRIPTION OF EXAMPLES

Figure 1:
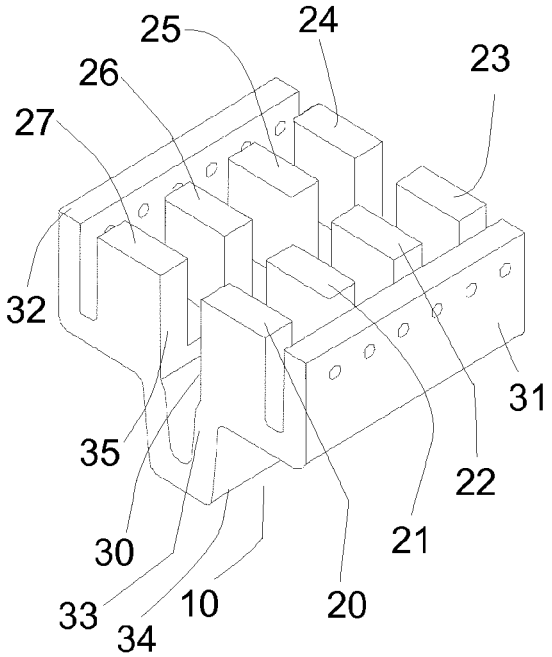
FIG. 1 shows a portion of a tool for manufacturing hot formed structural components according to an example.

FIG. 1 shows a portion of a tool for manufacturing hot formed structural components according to an example. The tool may comprise upper and lower mating dies. Each die may be formed by two or more die blocks adapted to operate at different temperatures corresponding to zones of a structural component to be formed having locally different microstructures and mechanical properties. In FIG. 1 only one die block 10 of the upper die is shown. A lower die will have a die block with a complementary shape.

A heated blank may be placed on top of the lower die. When the upper die moves downwards, the heated black will be formed and will obtain a shape corresponding substantially to a U-shape (in this particular case). The blank may be made e.g. of a boron steel, coated or uncoated, such as Usibor. During deformation, parts of the blank may be quenched, for example by passing cold water through channels provided in some of the die blocks. The blank is thus quenched and obtains a predetermined microstructure.

The die block 10 may be an electrically conductive die block which is electrically connected to a current source (not shown) configured to provide a DC current to control the temperature of the die block 10. The die block 10 may comprise two opposite lateral connectors 31 and 32, for example using copper bars attached at the connectors 31 and 32. The current source (not shown) may be connected to the opposite lateral connectors 31 and 32. This way, a current flow through the die block 10 may be created. This current may heat the block up, and the blank is thus not quenched along these portions. These portions can thus obtain a different microstructure and different mechanical properties.

The DC current may be regulated based on the temperature measured at the die block 10 electrically connected to a current source, thus a homogeneous heating of the die block 10 can be obtained. The temperature may be measured using one or more thermocouples. Furthermore, the current source may be operated in a pulse mode. The current source may be adapted to deliver DC current pulses of one or several microseconds of duration. The current source may also be capable of delivering pulses in a time-controlled manner in response to demand signals from e.g. a sensor. In some examples, the DC current may be obtained by rectifying an AC current between 1000 and 10000 Hz.

The die block 10 may comprise one or more working surfaces that in use may be in contact with the blank to be formed and one or more supporting blocks. In this particular example, the die block 10 may comprise a working surface 34 that, as commented above, in use may be in contact with a blank (not shown) to be formed and eight supports 20, 21, 22, 23, 24, 25, 26 and 27. In the example shown, the supports are shown to be integrally formed with the die block. The supports could however be separate components.

The electric current may flow from the lateral connector 31 across the U-shaped portion 33 (and thus at or near the working surface 34) of the die block 10 to the opposite lateral connector 32. In order to ensure this, the die block has to be adapted in such a way that the shortest path of the current flows in proximity of the working surface. Moreover, the faces of the supports 20, 21, 22, 23, 24, 25, 26 and 27 opposite to the working surface 34 may be isolated using an insulating material e.g. a ceramic material in order to avoid any current leakage to the rest of the die/tool. The faces of the supports 20, 21, 22, 23, 24, 25, 26 and 27 may be coated with an insulating material although some other options may be possible e.g. an external layer or other external element of insulating material.

The die block 10 in this example may comprise two internal faces 30 and 35. The two internal faces 30 and 35 may be arranged spaced apart from each other by a recess. A ventilator may be arranged to pass cooling air along the internal faces of warm die block to provide some cooling when needed.

Furthermore, the upper die may also comprise hot die blocks (not shown) which are not connected to a current source. For example, a further die block (not shown) may be provided. The further die block may comprise a heating source in order to be adapted to achieve higher temperatures ("hot block"). Furthermore, the upper and lower dies may include one or several cold blocks. These cold blocks may be cooled with cold water passing through channels provided in the block.

Throughout the present description and claims higher temperatures may generally be understood as temperatures falling within the range 350-600° C. and lower temperatures may be understood as temperatures falling below 250° C. to the room temperature.

The die blocks which are not connected to a current source and are adapted to achieve higher temperatures "hot blocks" may comprise one or more electrical heaters and temperature sensors to control the temperature of the "hot blocks". The sensors may be thermocouples. Each thermocouple may define a zone of the tool operating at a predefined temperature. Furthermore, each thermocouple may be associated with a heater or group of heaters in order to set the temperature of that zone. The total amount of power per zone (block) may limit the capacity of grouping heaters together.

The thermocouples may be associated with a control panel. Each heater or group of heaters may thus be activated independently from the other heaters or group of heaters even within the same block. Thus using a suitable software, a user will be able to set the key parameters (power, temperature, set temperature limits, water flow on/off) of each zone within the same block.

Other alternatives for adapting the die block to operate at higher temperatures (within 350-600° C.) may also be provided, e.g. a plurality of channels filled with a fluid suitable to be heated a different temperatures, embedded cartridge heaters.

Furthermore, the electrically conductive die block 10 of this figure may be provided with a cooling plate located at the surface of the supports 20, 21, 22, 23, 24, 25, 26 and 27 opposite to the working surface 34 comprising a cooling system arranged in correspondence with the die block 10. In further examples, the cooling plate may also be located at the surfaces opposite to the working surfaces of some other blocks e.g. "hot blocks" and/or "cold blocks". The cooling system may comprise cooling channels for circulation of cold water or any other cooling fluid in order to avoid or at least reduce heating of the die supporting blocks.

Figure 2:
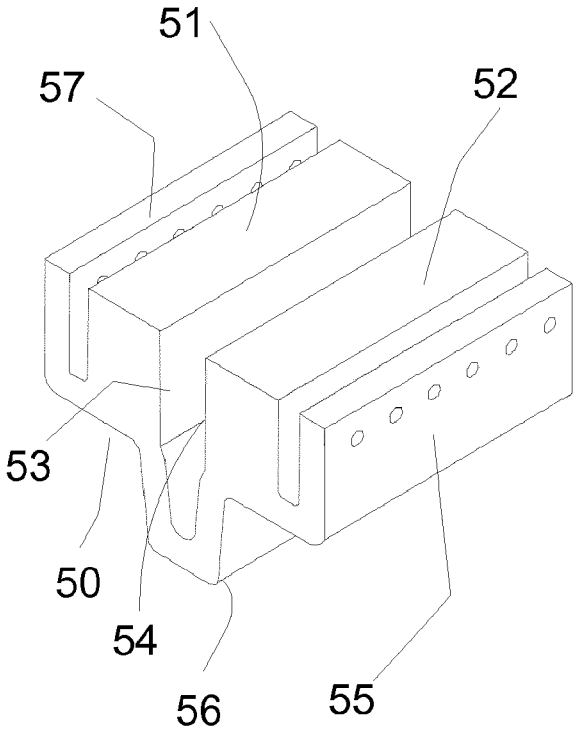
FIG. 2 shows a portion of a tool for manufacturing hot formed structural components according to another example.

The electrically conductive die block 10 may preferably be electrically insulated from neighbouring die blocks. For example, a gap may be arranged between neighbouring die blocks. This gap may permit the expansion of the blocks when they are heated. In some examples, the gap may be partially filled with an insulating material, but it may also be "empty", i.e. filled with air FIG. 2 shows a portion of a tool for manufacturing hot formed structural components according to another example. The example of figure number 2 differs from that of FIG. 1 in the number of supports.

The die block 50 may comprise a working surface that in use enters into contact with the blank (not shown) to be formed. In this particular example, the die block 50 may comprise a working surface 56 that, as commented above, in use may be in contact with a blank (not shown) to be formed. The die block further comprises two integrally formed supports 51 and 52. Moreover, the faces of the supports 51 and 52 opposite to the working surface 56 may be at least partially coated with an electrical insulating material e.g. a ceramic material although some other options may be possible e.g. an external layer or other external element of insulating material. Similarly as explained in connection with the FIG. 1, the die block 50 may comprise two opposite lateral connectors 55 and 57. The electric current may flow from the lateral connector 55 across the U-shaped portion (and thus the working surface 56) of the die block 50 to the opposite lateral connector 57.

The two supports 51 and 52 may comprise two internal faces 30 and 31. The two internal faces 53 and 54 may be arranged spaced apart from each other by a recess. This configuration may help to properly guide the DC current through the U-shaped part of the die block 50 (and the working surface 56), thus heating the working surface 56 up, which in use, is in contact with the structural component e.g. a blank. At the same time, a cooling channel is created by the space between internal faces 53 and 54.

This way, a current flow through the die block 50 may be created, thus the electrically conductive die block 50 may be heated up. With this arrangement, the different microstructures and mechanical properties of the structural component in the zone in contact with the electrically conductive heated block 50 may be modified. Furthermore, the particular configuration of the supporting blocks may result in a particular heat generation and heat distribution with respect to the die block of the FIG. 1.

Figure 3:
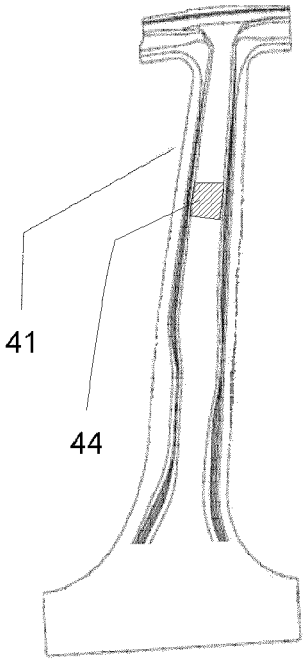
FIG. 3 shows an example of a component with soft zones.

The FIG. 3 shows an example of a component with soft zones. In this example, a B-pillar 41 is schematically illustrated. The B-pillar 41 may be formed e.g. by a HFDQ process. In some examples, the component 41 may be made of steel although some other materials may be possible, preferably an Ultra High Strength Steel.

The soft zone 44 may be provided with a different microstructure having e.g. increasing ductility. The selection of the soft zone may be based on crash testing or simulation test although some other methods to select the soft zones may be possible. The soft zone areas may be defined by simulation in order to determine the most advantageous crash behaviour or better absorptions in a simple part such as e.g. a B-pillar.

A tool as described in any of FIGS. 1-2 may be provided. With such a tool, an electrically conductive die block may be heated up, thus the different microstructures and mechanical properties of the B-pillar 41 in the area 44 in contact with the heated block ("soft zone") may be changed.

In this way, the soft zone 44 may have enhanced ductility, while the strength of the parts next to the soft zone may be maintained. The microstructure of the soft zone 44 may be modified and the elongation in the soft zone 44 may be increased.

A B-pillar may comprise more than one soft zone. One of the soft zones may be formed by heating a die block using a DC current as in the methods described before. This is particularly suitable for soft zones having a relatively constant cross-section, and/or a relatively simple cross-section (e.g. relatively close to a Hat shaped or U shaped cross-section).

More complicated soft zones may be formed using different techniques within a HFDQ process, e.g. warm die blocks having electrical heaters. Alternatively, certain soft zones may preferably be formed after an HFDQ process using e.g. a laser.

Figure 4:
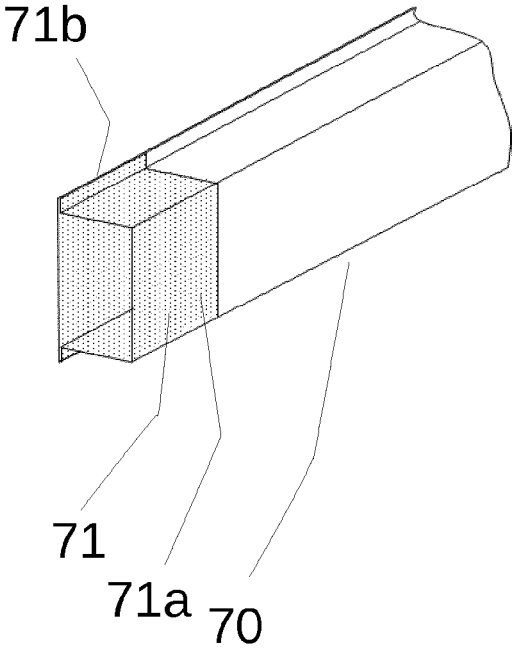
FIG. 4 shows another example of a component with a soft zone.

FIG. 4 shows another example of a component with soft zones. In this example a side rail 70 is schematically illustrated. The component and in particular the piece with a U-shaped cross-section may be formed using e.g. HFDQ.

The zone 71 may be selected to change the structure e.g. increasing ductility. The selection of the soft zones 71 and the operation of the die block may be the same as described as described with respect to FIG. 3. The change of the microstructure e.g. increasing ductility may be performed in each part 71*a* and 71*b* separately. Once the soft zone in both parts 71*a* and 71*b* is manufactured, the parts may be joined together e.g. by welding so as to form the side rail 70.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A tool for manufacturing hot formed structural components comprising:

a current source; and a die comprising an upper mating die and a lower mating die, each of the upper mating die and the lower mating die comprising a plurality of die blocks, wherein the plurality of die blocks include:

at least one warm die block comprising lateral connectors on external sides thereof, a plurality of supporting blocks, and a working surface, wherein:

the lateral connectors are electrically connected to the current source and are configured to provide a DC current through one of the lateral connectors through the working surface and through another of the lateral connectors, and internal faces of the plurality of supporting blocks are spaced apart from each other by a recess; and at least one cold die block comprising a plurality of channels configured to conduct a cooling liquid.

2. The tool according to claim 1, wherein the current source is configured to regulate the DC current based on a temperature measured at the at least one warm die block.

3. The tool according to claim 2, further comprising one or more thermocouples configured to measure the temperature.

4. The tool according to claim 1, wherein the current source is configured to provide a series of DC current pulses.

5. The tool according to claim 1, wherein the at least one warm die block further comprises one or more electrical heaters.

6. The tool according to claim 5, wherein the one or more electrical heaters are activated independently.

7. The tool according to claim 1, wherein the plurality of die blocks further include a second warm die block comprising channels configured to conduct a hot liquid.

8. The tool according to claim 1, wherein the plurality of supporting blocks are arranged on opposite sides of the working surface, and wherein the plurality of supporting bocks are electrically isolated.

9. The tool according to claim 8, wherein the plurality of supporting blocks are partially coated with an electrical insulating material.

10. The tool according to claim 8, wherein the insulating material is a ceramic material.

11. The tool according to claim 1, wherein the current source is configured to provide the DC current by rectifying an AC current between 1000 and 10000 Hz.

12. The tool according to claim 1, further comprising:

a second warm die block comprising a plurality of supporting blocks and a working surface, wherein the second warm die block is not connected to the current source; and a cooling plate located at surfaces of the plurality of supporting blocks of the second warm die block opposite to the working surface of the second warm die block.

13. A method for manufacturing hot formed structural components using the tool according to claim 1, the method comprising:

compressing a blank between the upper and lower mating dies;

connecting the lateral connectors of the at least one warm die block to the current source; and operating, by applying the DC current, the at least one warm die block and the at least one cold die block corresponding to zones of the blank to provide the blank with locally different microstructures and mechanical properties.

* * * * *